United States Patent [19]

Micheletti

[11] 4,120,177

[45] Oct. 17, 1978

[54] RADIALLY INSERTABLE AND PIVOTABLE CAMS

[75] Inventor: Fabrizio Micheletti, Fucecchio, Italy

[73] Assignee: Brematex S.p.A., Prato, Italy

[21] Appl. No.: 817,346

[22] Filed: Jul. 20, 1977

[30] Foreign Application Priority Data

Jul. 20, 1976 [IT] Italy ..... 9533 A/76

[51] Int. Cl.[2] ..... D04B 9/00

[52] U.S. Cl. ..... 66/40; 66/57

[58] Field of Search ..... 66/57, 50 R, 42, 40, 66/46, 49, 43, 58, 14 (U.S. only), 25

[56] References Cited

U.S. PATENT DOCUMENTS

| | | | |
|---|---|---|---|
| 1,678,385 | 7/1928 | Grothey | 66/50 R |
| 2,260,579 | 10/1941 | Miller | 66/40 |
| 3,148,518 | 9/1964 | Peel et al. | 66/42 |
| 3,299,673 | 1/1967 | Noll | 66/57 |
| 3,449,928 | 6/1969 | Schmidt et al. | 66/57 X |
| 3,662,572 | 5/1972 | Lonati | 66/57 X |
| 3,726,110 | 4/1973 | Conti | 66/57 |
| 3,780,539 | 12/1973 | Mishcon | 66/57 |

FOREIGN PATENT DOCUMENTS

| | | | |
|---|---|---|---|
| 733,509 | 10/1932 | France | 66/57 |

*Primary Examiner*—Werner H. Schroeder
*Assistant Examiner*—Andrew M. Falik
*Attorney, Agent, or Firm*—Richards, Shefte & Pinckney

[57] ABSTRACT

Means for selectively positioning needles in a circular knitting machine wherein a radially movable needle positioning cam is insertable from an inoperative position out of the path of control butts of needles or jacks into fully inserted or partially inserted positions to selectively engage all the butts or only long butts. A needle raising cam is mounted in advance of the needle positioning cam with its advance end pivoted for positioning of the raising cam down out of the path of control butts, in a fully raised position engaging the control butts to raise them clear of the positioning cam during insertion of the positioning cam, or in an intermediate inclined position to raise the control butts for engagement with the positioning cam at an inclination that permits high speed operation. The raising cam is mounted on a shaft that is operated by a mechanism that is driven from a pattern drum mounted on the machine coaxial and underlying the needle cylinder.

3 Claims, 9 Drawing Figures

10
f1
9
T
16A
5
7
14
12
20
18
16

RADIALLY INSERTABLE AND PIVOTABLE CAMS

BACKGROUND OF THE INVENTION

The present invention relates to means for selectively positioning needles in a circular knitting machine, and more particularly to needle raising cams and associated clearing cams.

Needle positioning cams of various types are well known in the art for manipulating needles to produce various knitting functions. As these needle positioning cams must be introduced into the normal path of the control butts of needles or jacks in order to effect needle manipulation, special motions must be provided for introducing the cams or additional cam mechanisms with complicated linkages utilized or special control butt patterns provided so that the cam can be inserted in a space where there are no butts.

By the present invention, a simple radially insertable needle positioning cam is used with a pivoted needle raising cam in advance of the positioning cam to clear the control butts during insertion of the needle positioning cam and to raise the control butts for engagement with the positioning cam when it is in its inserted position, and this is accomplished with a simple and inexpensive mechanism without special patterns of needle or jack butts. Furthermore, the raising cam can be positioned at a relatively low incline for preliminary raising of needles to the positioning cam so that high speed cylinder rotation can be accommodated.

SUMMARY OF THE INVENTION

Briefly described, the means for selectively positioning needles in a circular knitting machine according to the present invention includes a needle positioning cam readily movable into and out of the path of needle control butts. A needle raising cam is mounted on the machine in advance of the needle positioning cam and is pivoted at its advance end for pivoting from a lower inoperative position out of the path of the control butts to an inclined clearing position in the path of the control butts for raising the control butts to clear the positioning cam. Means are included for pivoting the raising cam to the clearing position to permit insertion of the positioning cam without interference of the control butts.

In the preferred embodiment of the present invention the cam pivoting means is operable to pivot the raising cam to an intermediate inclined position in which the control butts are raised to an intermediate level for an engagement with the needle positioning cam, and the inclination of the raising cam is less in the intermediate position than in the clearing position to accommodate higher machine operating speeds in the intermediate position than the clearing position. The needle positioning cam is movable fully into the path of the control butts for engagement of all butts and is alternatively movable partially into the path of the control butts for engagement of long control butts and non-engagement of short control butts.

DETAILED DESCRIPTION OF THE PREFERRED EMBODIMENT

Figure 1:
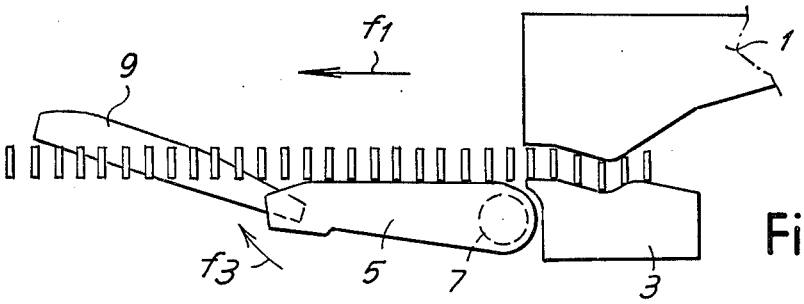
FIG. 1 is an elevational view of a cam assembly incorporating the means for selectively positioning needles of the preferred embodiment of the present invention, with the cams in their inoperative positions.

Referring to the drawings, the numeral 1 indicates a stitch cam with a cooperating counter-cam 3. Downstream of the pair of cams 1 and 3, with respect to the movement of the control butts T of the needles or jacks in the direction of the arrow *f*1, a needle raising cam 5 is mounted for pivoting about a radial shaft 7. This needle raising cam 5 engages all the control butts T when it is pivoted on the shaft 7 from an inoperative position as shown in FIG. 1 to one of the operative positions shown in FIGS. 3, 5 and 7, in clockwise direction as indicated by the arrow *f*3 of FIG. 1. A movable needle positioning cam 9 of the slider type, that is latch cam or the like, is mounted for radial movement with respect to the needle cylinder 10, the movement of the cam 9 being shown by the double arrow *f*5.

Figure 9:
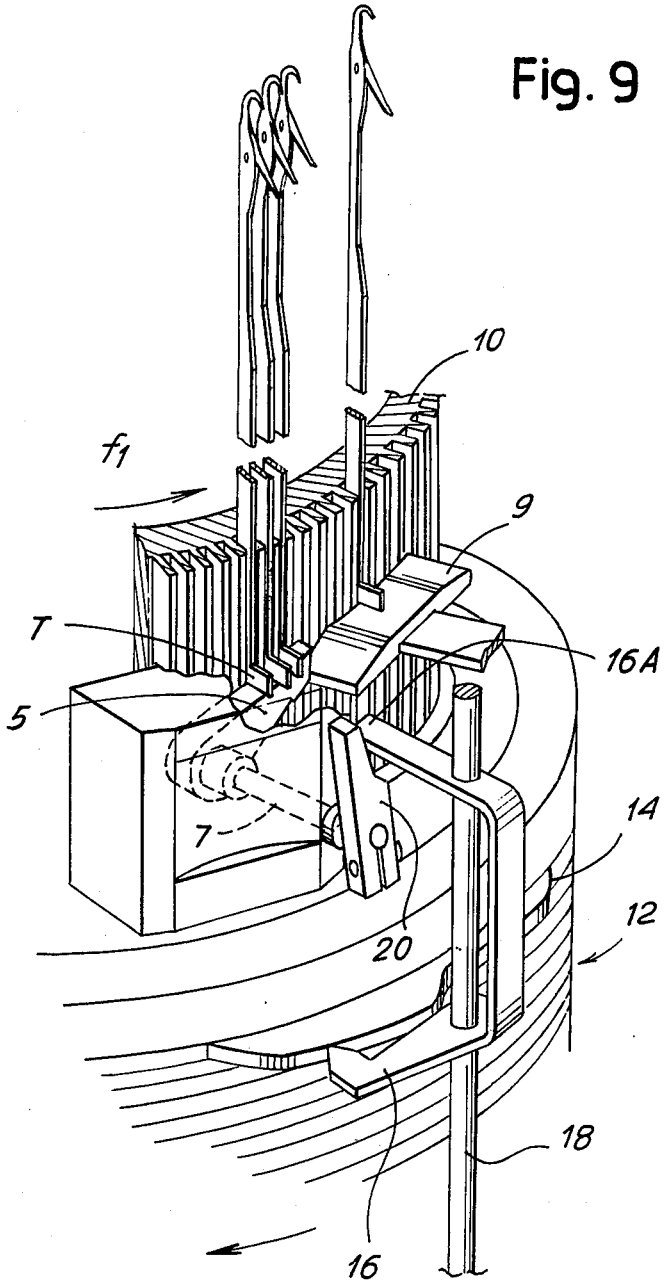
FIG. 9 is a perspective view of a portion of a knitting machine showing the cam assembly of the preceding figures and the operating mechanism for the needle raising cam.

The movement of the needle positioning cam 9 is provided in a conventional manner for the movement of such known cams. Also, the movement of the needle raising cam 5 may be provided in any manner, and in FIG. 9 there is shown a preferred form of means for moving the cam, from a cam drum generically denoted by 12 and extending coaxial to the needle cylinder and underlying thereto. A cam 14 acts on a follower 16 oscillating around the axis of a column 18, with the follower 16 and its arm 16A acting, against the counteraction of a conventional elastic means (not shown), on an extension 20 assembled on the shaft 7 and thus integral to the cam 5. In this way, the pivoting of the shaft 7 and thus of the cam 5 is determined as a function of the profile of the cam 14.

Whatever may be the operation mode for the cams which can act on the needle or jack butts T, the function of the cam assembly according to the above is as follows.

Figure 2:
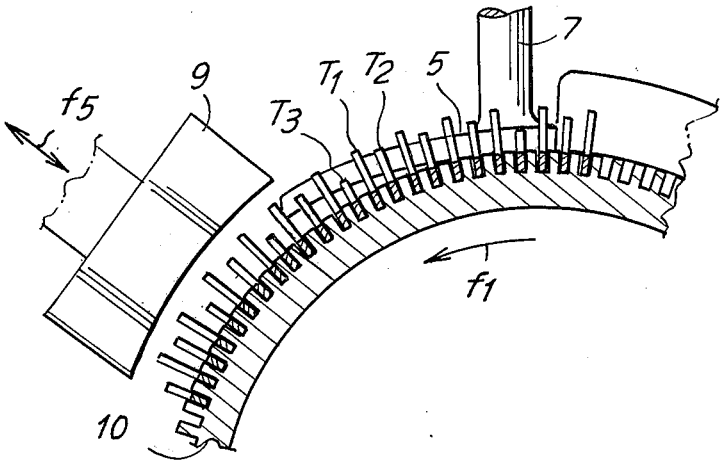
FIG. 2 is a horizontal sectional view showing the cam assembly of FIG. 1 in plan.

Under the conditions shown in FIGS. 1 and 2, the needle positioning cam 9 being retracted and the needle raising cam 5 being in its lower positioned out of the path of the control butts T, the butts are not engaged by either of the two cams, and the path of the butts T is that shown in particular in FIG. 1. The butts T may have different lengths, as shown for instance in FIG. 2, wherein it is to be noted that the butts are divided into groups in which butts T1 having a maximum length are present on alternate needles or jacks and butts on intermediate needles are alternately of an intermediate length as shown by T2 and a minimum length as shown in T3. In other words, the sequence of needle butts is: T1, T2, T1, T3, T1, T2, T1, T3 . . . .

Figure 4:
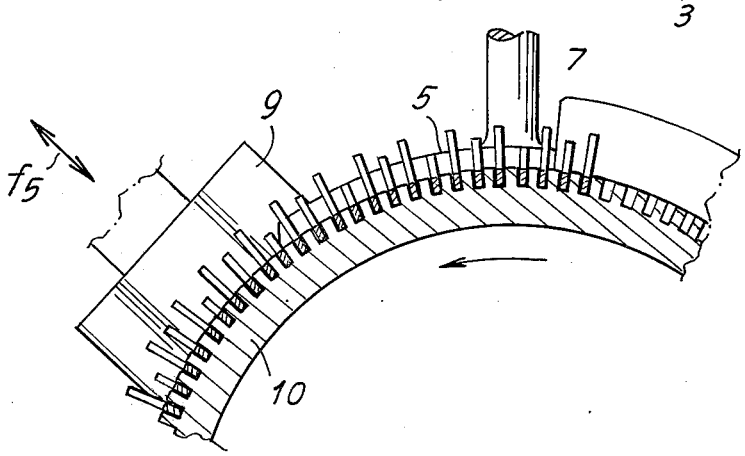
FIG. 4 is a view similar to FIG. 2 showing the cams in the position of FIG. 3.
Figure 5:
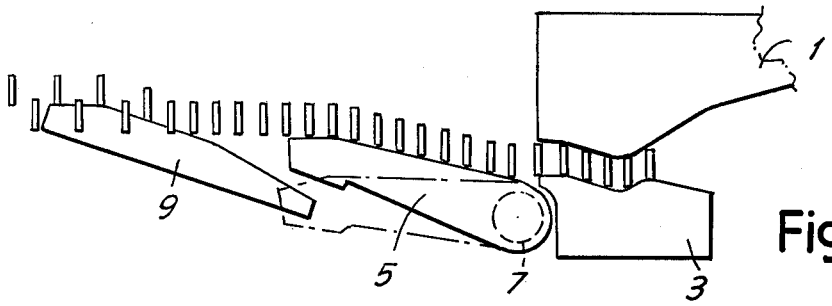
FIG. 5 is a view similar to FIG. 1 showing the needle raising cam in its intermediate position and the needle positioning cam engaging butts of alternate needles.
Figure 6:
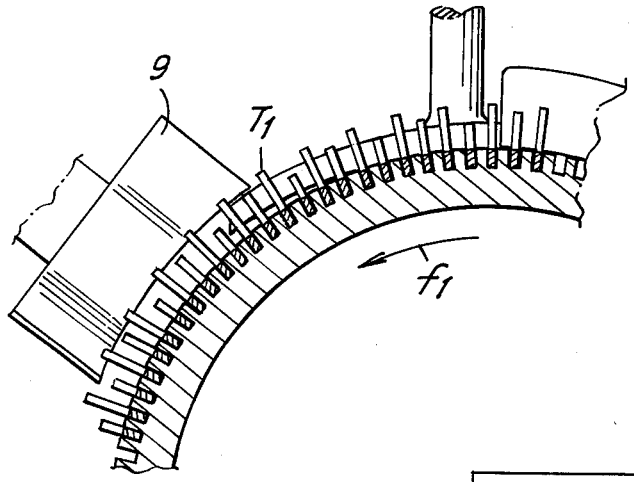
FIG. 6 is a view similar to FIG. 2 showing the cams in the positions shown in FIG. 5.
Figure 7:
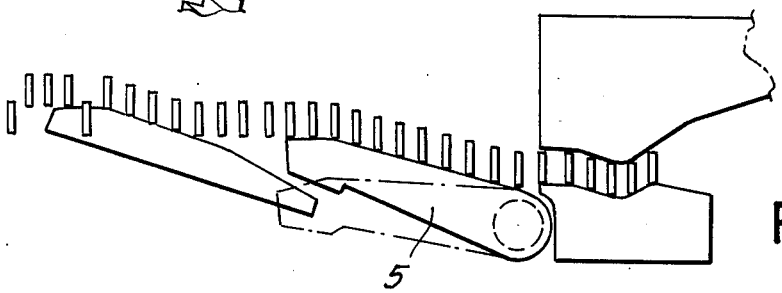
FIG. 7 is a view similar to FIG. 5 showing the needle positioning cam engaging control butts of three of every four needles.
Figure 8:
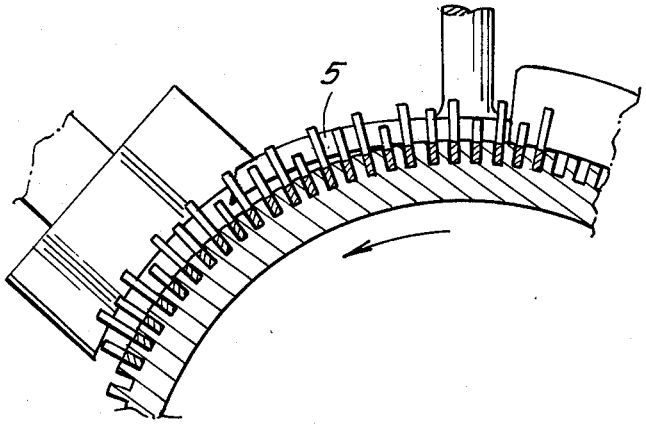
FIG. 8 is a view similar to FIG. 6 showing the cams in the positions shown in FIG. 7.

It is to be noted that when the needle positioning cam 9 is retracted, the needle raising cam 5 can be moved in seaming interference with the cam 9 in radial view, as the one shown in FIG. 1, where in fact the cams are radially spaced as seen in FIG. 2. It is also to be noted that the needle positioning cam 9 may be moved into several positions in a direction according to the double arrow *f*5. In particular, the cam 9 can be operated: (I) to be retracted from operation as shown in FIG. 2; (II) to be totally inserted into operation as shown in FIG. 4 to engage all the butts; (III) to be inserted into an intermediate position to engage only the butts T1 as shown in FIGS. 5 and 6, in such a manner as to operate the raising only of alternate needles; or (IV) to be inserted into a more advanced intermediate position as shown in FIGS. 7 and 8, in which it engages the butts T1 and the butts T2, with a three-to-one selection, that is three butts engaged (T1 and T2) and one butt not engaged (T3), and with a corresponding needle raising.

Figure 3:
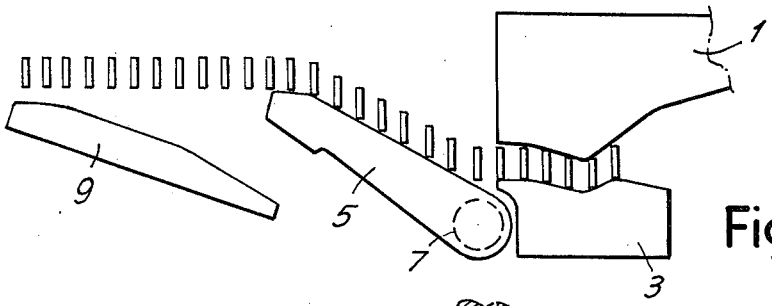
FIG. 3 is a view similar to FIG. 1 showing the needle positioning cam fully inserted and the needle raising cam fully raised to clear needles from the needle positioning cam.

From the conditions shown in FIGS. 1 and 2, it is possible to provide for the operation of the needle raising cam 5 to a highly inclined arrangement, as shown in FIGS. 3 and 4, in which all the butts are engaged and thereby all the needles raised to a knit level, with a relatively highly inclined ramp, which may require a temporary reduction in the speed of the needle cylinder. This condition of maximum raising of the cam 5, as shown in FIGS. 3 and 4, permits insertion of the cam 9 for total or partial insertion without contact or interference with any of the butts. In this way the needle positioning cam 9 can reach either of the positions shown in FIGS. 6 and 8, to obtain the total raising of all the needles (FIG. 4) or the partial raising according to the one-by-one selection (FIG. 6), or the three-to-one selection (FIG. 8), according to the selected program. Immediately after the cam 9 has assumed the desired position, the needle raising cam 5 is partially lowered to a tuck loop condition, from the position of FIG. 3 to the position of FIG. 5 or FIG. 7, or to the retracted position indicated in phantom in FIGS. 5 and 7.

In the positions of the needle raising cam 5, the rise imparted to the butts is relatively gradual, and thus a relatively high speed of the needle cylinder may be accommodated. Also, the rise of the needles by the action of the cam 9 in its intermediate positions is sufficiently gradual to allow the raising of the needles with a very high speed of the cylinder, with the path of the needles shown in FIG. 5 or 7 to raise selected needles to the tuck level and other needles to the knit level.

Apart from the radial movements of the needle positioning cam 9 to control the selection of needles by this cam 9, retraction of the cam 9 from operation permits the lowering of the needle raising cam 5 to the inoperative position shown in FIG. 1, after the needle positioning cam 9 has been sufficiently retracted from the needle cylinder.

The cam arrangement of the present invention permits many variations of control with elimination of or at least with a substantial minimization of the slowing down of the needle cylinder as conventionally required, and thereby with a substantial advantage in the productivity of the machine. Moreover, the possibility of breakdowns of butts of the jacks or needles is minimized. This also avoids having to the needles with butt areas having different heights to allow the introduction of the cam; and to increase the utilization of the butt heights to obtain the pattern selections and the like.

It is intended that the drawing illustrates only a preferred embodiment of the invention for disclosure purposes, said invention being in conditions as to be varied in form and arrangements without departing from the scope of the concept characterizing the same invention, which is intended to be limited only by the scope of the appended claims.

I claim:

1. In a circular knitting machine, means for selectively positioning needles comprising a needle positioning cam radially movable into and out of the path of needle control butts, a needle raising cam mounted on the machine in advance of said needle positioning cam and being pivoted at its advance end for pivoting from a lower inoperative position out of the path of said control butts to an inclined clearing position in the path of said control butts for raising said control butts to clear said positioning cam, and allow insertion of said positioning cam without interference with said control butts and means for pivoting said raising cam to said clearing position to permit insertion of said positioning cam without interference with the control butts.

2. In a circular knitting machine, means for selectively positioning needles according to claim 1 and characterized further in that said cam pivoting means is operable to pivot said raising cam to an intermediate inclined position in which said control butts are raised to an intermediate level for engagement with said needle positioning cam, the inclination of said raising cam being less in said intermediate position than in said clearing position to accommodate higher machine operating speeds in the intermediate position than the clearing position.

3. In a circular knitting machine, means for selectively positioning needles according to claim 1 and characterized further in that said needle positioning cam is movably fully into the path of said control butts for engagement of all butts and is alternatively movable partially into the path of said control butts for engagement of long control butts and non-engagement of short control butts.

* * * * *

UNITED STATES PATENT OFFICE

CERTIFICATE OF CORRECTION

Patent No. 4,120,177 Dated October 17, 1978

Inventor(s) Fabrizio Micheletti

It is certified that error appears in the above-identified patent and that said Letters Patent are hereby corrected as shown below:

Column 2, line 62, after "lower" insert --inoperative--; Column 2, line 62, delete "positioned" and insert therefor --position--; Column 4, line 12, after "to" insert --provide--; Column 4, line 14, delete "to increase the" and insert therefor --allows increased--; Column 4, line 52, delete "movably" and insert therefor --movable--.

Signed and Sealed this

*Third* Day of *April 1979*

[SEAL]

*Attest:*

RUTH C. MASON
*Attesting Officer*

DONALD W. BANNER
*Commissioner of Patents and Trademarks*